United States Patent [19]

Haugs

[11] Patent Number: 5,050,465

[45] Date of Patent: Sep. 24, 1991

[54] PLIERS DEVICE

[76] Inventor: Audun Haugs, Natlandsfjeller 56 - N-5030, Landas, Norway

[21] Appl. No.: 469,556

[22] PCT Filed: Sep. 26, 1988

[86] PCT No.: PCT/NO88/00071

§ 371 Date: Apr. 26, 1990

§ 102(e) Date: Apr. 26, 1990

[87] PCT Pub. No.: WO89/02806

PCT Pub. Date: Apr. 6, 1989

[30] Foreign Application Priority Data

Sep. 25, 1987 [NO] Norway ..... 874022

[51] Int. Cl.[5] ..... B25B 13/12

[52] U.S. Cl. ..... 81/126; 81/358; 81/135

[58] Field of Search ..... 81/126, 127, 133, 135, 81/343, 357-362

[56] References Cited

U.S. PATENT DOCUMENTS

| | | | |
|---|---|---|---|
| 901,174 | 10/1908 | Johnson | 81/357 |
| 1,082,601 | 12/1913 | McCarthy | 81/135 |
| 1,440,346 | 12/1922 | Eshelman | 81/133 |
| 2,112,873 | 4/1938 | Wright | 81/343 |
| 2,313,270 | 3/1943 | Sapp | 81/358 X |
| 2,906,155 | 9/1959 | Miller | 81/343 |
| 3,253,487 | 5/1966 | Bentley | 81/343 X |

*Primary Examiner*—James G. Smith

*Attorney, Agent, or Firm*—Kenyon & Kenyon

[57] ABSTRACT

Pliers comprising a stationary pliers member (10) with associated first jaw member (11) and a moveable pliers member (12) with associated second jaw member (13). Jaw member (13) of the moveable pliers member is moveable towards and away from jaw member (11) of the stationary pliers member by means of an actuating handle (21) pivotable relative to the stationary pliers member (10). The second jaw member (13) is moveable towards the first jaw member (11) in a two-step movement, that is to say with a first movement with relatively long length of movement and with relatively little force by means of a first actuating means (17, 19) between the actuating handle (21) and the moveable pliers member (12) and with a second movement with relatively short length of movement and with relatively large force by means of a second actuating means (26) between the actuating handle (21) and the moveable pliers member (12).

7 Claims, 4 Drawing Sheets

PLIERS DEVICE

Heretofore, various types of pliers devices have been known which are constructed with a stationary pliers member with an associated jaw member and a movable pliers member with a second jaw member wherein the movable pliers member is movable relative to the stationary pliers member so as to move the two jaw members relative to each other. Generally, movement of the movable pliers member is effected by means of an actuating handle which can be pivotally mounted on the stationary pliers member.

Briefly, the invention provides a pliers device having a first pliers member with a first jaw member, a second pliers member movably mounted in the first pliers member and having a second jaw member opposite the first jaw member and an actuating handle pivotally mounted on the first pliers member. In addition, a first actuating means is provided between the handle and the second pliers member for moving the second pliers member relative to the first pliers member in response to pivoting of the handle in order to move the jaw members toward each other to close on an object therebetween. In addition, a second actuating means is provided between the handle and the second pliers member for moving this member relative to the first pliers member in response to pivoting of the handle in order to move the jaw members toward each other to exert a clamping force on an object held therebetween.

In accordance with the invention, the pliers device is easy to rearrange from an inactive position to a clamp engaging position in a first phase of a movement operation and which thereafter, in a second movement operation, are easy to adjust with a desired readily regulatable holding force and/or a desired readily regulatable clamping force.

The pliers according to the invention can find different forms of application. In a first case, the pliers can be utilised as a tool for clamping together an object with a relatively large clamping force, for example as nutcrackers for cracking nuts, and then especially cracking nuts with mutually different dimensions, but with an equal or substantially equal clamping force. In a second case, the pliers can be employed as holding means, where the clamping force does not necessarily need to be especially large, but on the other hand can be maintained at a stable and uniform level, for example for securing a work piece and/or securing a ground wire in connection with an electrical welding operation. In the last-mentioned case, the aim is especially pliers, which in a relatively simple and rapid manner can establish reliable earthing contact in a work piece via the pliers, at the same time as the pliers shall be able to support the weight of an earth cable of large dimensions. In addition, the aim is to employ the pliers for conventional clamping and holding operations in connection with various working operations, for example within mechanical industry, within the plumbing trade, etc.

The pliers device according to the invention is characterised in that the second jaw member is moveable towards the first jaw member in a two-step actuating operation, that is to say a first step with a relatively, comparatively long length of movement between the jaw members and with relatively small force, by means of a first actuating means between the actuating handle and the moveable pliers member and a second step without relative movement or with a moderate relative movement with relatively short length of movement and with relatively large force, by means of a second actuating means between the actuating handle and the moveable pliers member.

In this way pliers are obtained, where the two-step movements form part of a coherent movement of the actuating handle and where the jaw members are first automatically adjusted into engagement with the object which is to be secured/clamped, independently of the thickness of the object which the pliers are to engage with, and where thereafter there is directly exerted a suitable holding force or a suitable clamping force, substantially independent of the size of the object which is to be secured/clamped, that is to say independent of the distance between the jaw members in their clamp engaging position.

According to the invention one can adjust the jaw members with the first actuating means into an active engagement with an object which is to be secured between these, by means of a simple pivoting of the actuating handle relative to the stationary pliers member. This adjustment of the jaw members into engagement with an intermediate object can be effected easily and simply without having to pay attention to the actual thickness of the object. Thereafter, with the second acutating means one can exert, by means of a continued, relatively small extra pivoting of the actuating handle, an extra clamping force between the jaw members or exert a desired holding force between the jaw members, by an equivalent manual regulation of the actuating force which is exerted against the actuating handle.

The solution according to the invention can be utilised in different types of pliers, but it is preferred that the moveable pliers member is axially moveable in a control in the stationary pliers member. By this there is achieved, in a manner known per se a simple and effective sliding control between the stationary and the moveable pliers members.

It is preferred that the first actuating means comprises a toothed wheel which is rotatably mounted at the outer end of an actuating arm, the opposite end of which is pivotably mounted on the actuating handle, the toothed wheel standing in rotary engagement with a first rack on the stationary pliers member and on the diametrically opposite side standing in rotary engagement with a second rack on the moveable pliers member.

By this, there is obtained with a relatively small pivotal arc for the actuating handle, a relatively large axial movement of the moveable pliers member towards and away from the stationary pliers member, by means of the first actuating member. This means that relatively rapidly and easily, that is to say with relatively little force, one can adjust the pliers members from an opened, inactive position to a closed, active engaged position with the actual object which is to be clamped or secured with the pliers. In other words, the aim is an adjustment of the pliers to the active engagement position which is almost automatic, independent of the thickness of the object which is to be clamped and then with a rather moderate actuating force in the first actuating step. Further, it means that thereafter, without additional movement between the pliers members or only with a limited additional movement between the pliers members, there can be ensured an effective holding force or an effective clamping force in the pliers, with the possibility for significant regulation of the force which is exerted between the jaw members of the pliers. For one thing it will be possible, during the pivoting together of the pliers in the first phase of movement, to obtain automatically a ready adjustment of the jaw members, in correspondingly reliable engagement with objects of different thickness, that is to say with the jaw members adjusted at different distances relative to each other for engagement with an intermediate object, without exerting particular clamping force. Furthermore it will be possible thereafter, in a correspondingly automatic manner, to adjust the holding force or the clamping force particularly effectively, by putting in use a second actuating means, with which there can be exerted a relatively stable and uniform holding force or an especially strong clamping force, as required.

Instead of toothed wheels and associated racks there can be employed if desired a joint arm mechanism, so as to produce a relatively large axial movement in the second pliers member, by a moderate pivotal movement of the actuating handle. Alternatively, instead of a joint arm mechanism, which gives a relatively large axial movement for the second pliers member, one can employ a simple joint arm or similar simple connection, which gives a moderate axial movement of the second pliers member, in instances where for example there are moderate deviations in thickness of the objects which are to be secured or clamped by the pliers.

It is preferred that the said second actuating means is moveable to a separate engagement position in connection with the moveable pliers member, against the force of a spring, so that the moveable pliers member can be clamped against the object which is to be fixed with a uniformly increasing clamping force after the first step of the fixing operation is conducted. By this, there is the possibility of being able to clamp objects of different thickness in an easy and accurate manner by adjusting the abutment between the jaws and the object which is to be clamped via the spring. In other words one can ensure by means of the spring the transfer of an additional increased, considerable clamping force between the jaw members, immediately the force from the spring is overcome. Correspondingly one can ensure, that when the pressure in the pliers is relieved, the spring can assist with returning the second actuating member to the inactive position in order to allow the repositioning of the jaw members to an equvalent inactive, open position.

The second actuating member can take many different forms. It is preferred that the second actuating member comprises a sliding pawl, one end of which is fastened to the actuating handle and the opposite end of which is adapted to form a supporting abutment against a relevant locking groove in a series of locking grooves, which are arranged along the adjacent side edge of the moveable pliers member.

In this way, the jaw members can be secured in locking engagement with each other with a set, moderate pressure between the jaw members without additional manual actuating force, in such instances where this is of interest.

Further features of the invention will be evident from the following description having regard to the accompanying drawings, in which.

Figure 3:
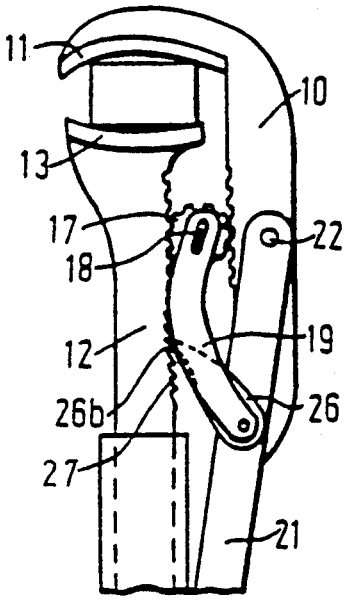
FIG. 3 shows in side view a part of the pliers according to FIG. 1 after a second step of the two-step movement is conducted.
Figure 3A:
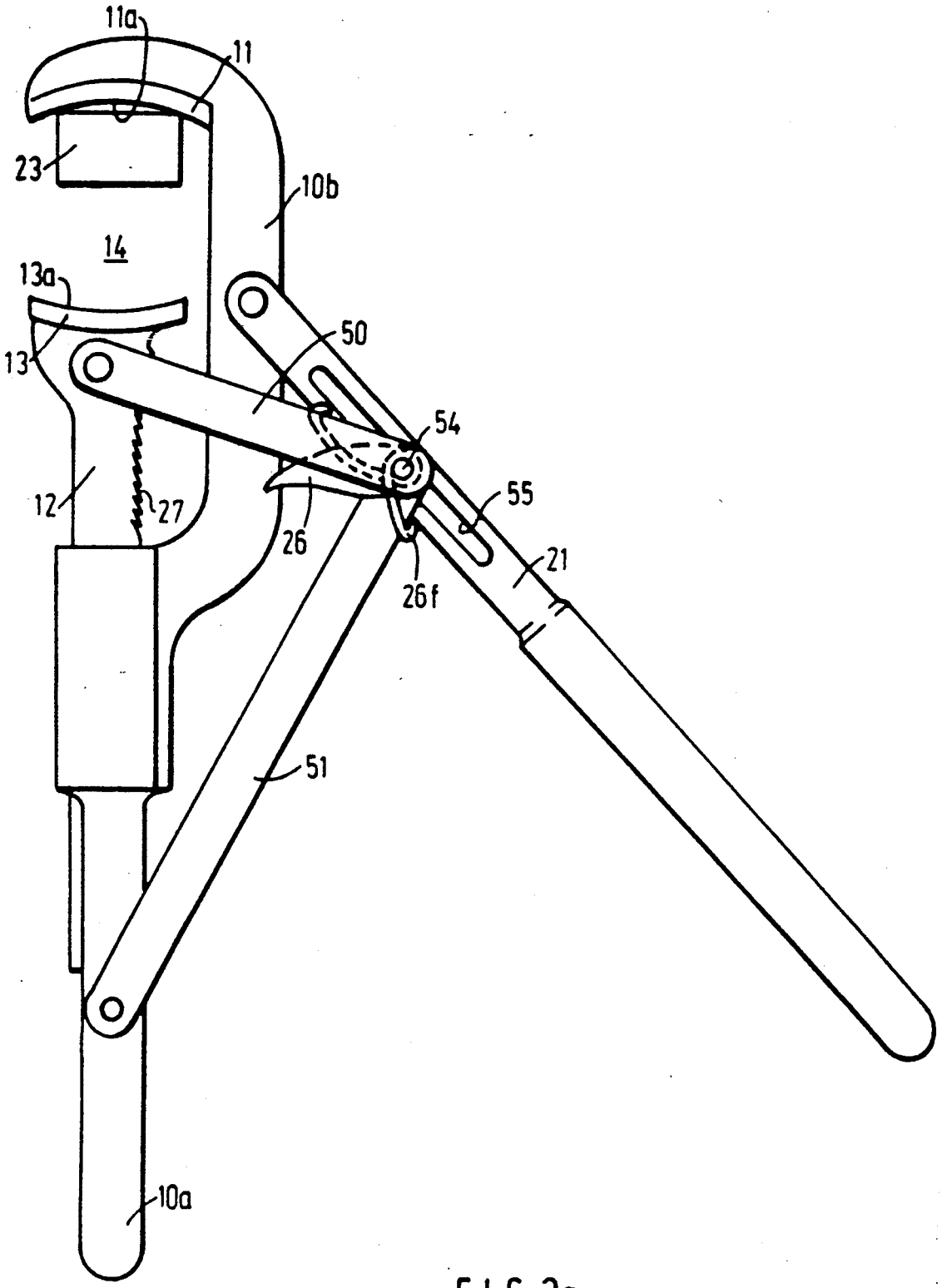

FIG. 3*a* shows a side view of a modified pliers in accordance with the invention.

Figure 4:
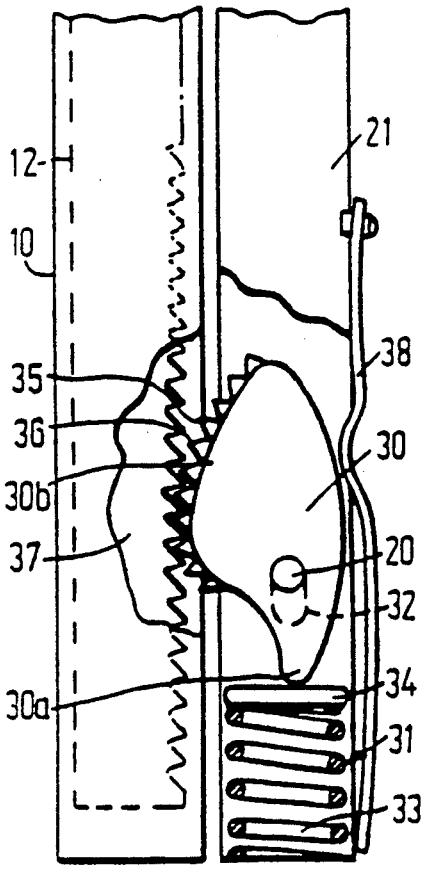

FIG. 4 shows a part of the pliers according to an alternative embodiment, illustrated with a locking member in an unstable locking engagement position.

Figure 5:
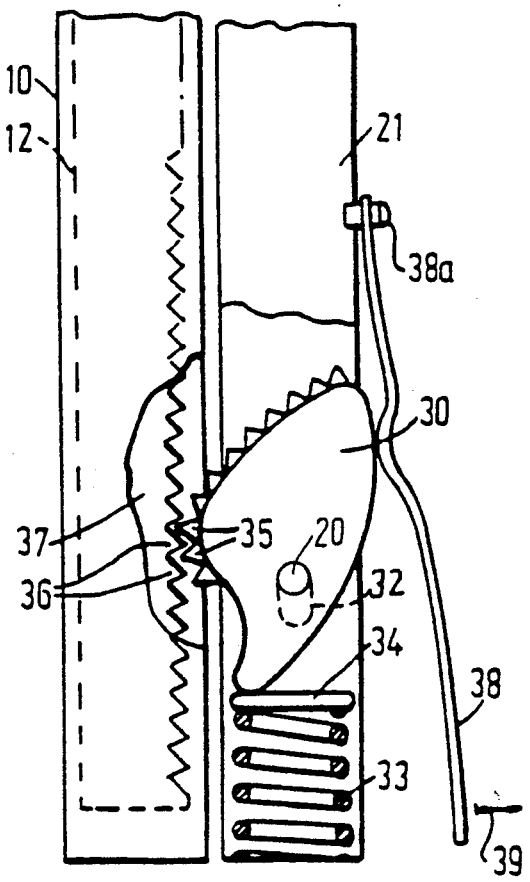

FIG. 5 shows the same as in FIG. 4, illustrated with the locking member in a stable locking engagement position.

Figure 6:
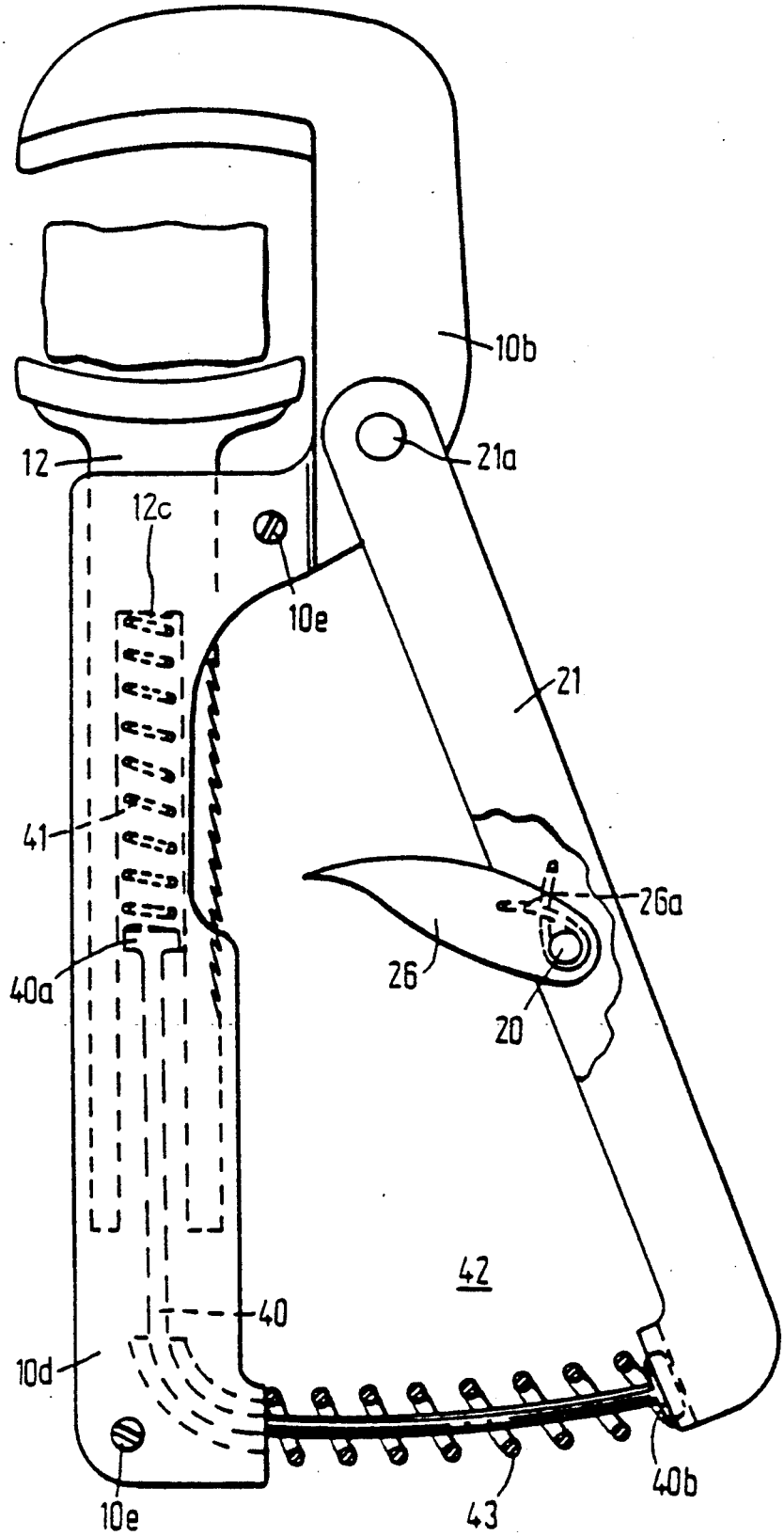

FIG. 6 shows a modified construction of the pliers according to the invention, illustrated in a view from the side.

Figure 1:
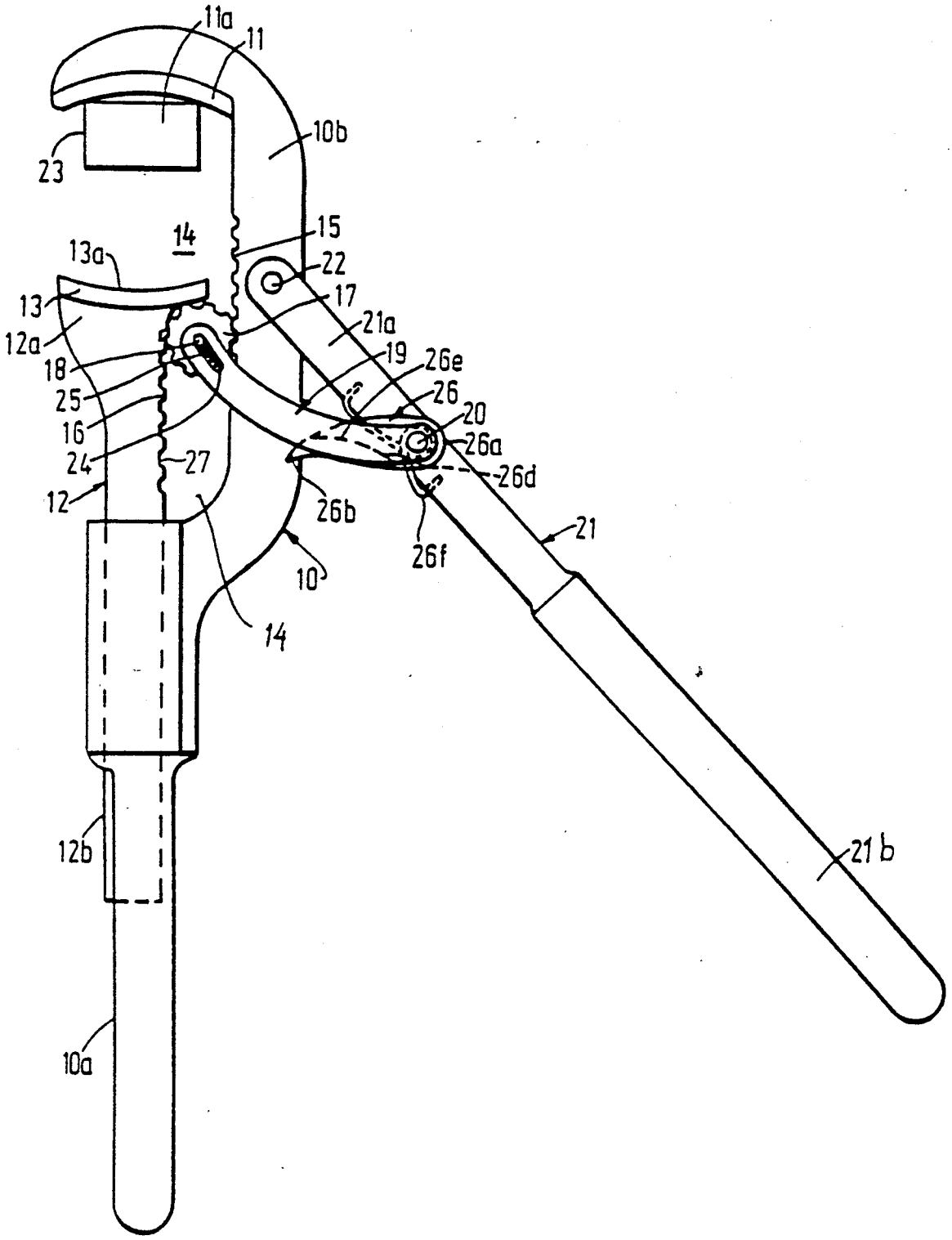
FIG. 1 shows in a side view the pliers according to the invention with its jaw members illustrated in an inactive position, ready for relative movement thereof into a common clamping engagement with an intermediate object.

In FIG. 1 there is shown a stationary pliers member 10 with associated jaw member 11, which projects laterally outwards from the main direction of the pliers member 10. Further there is shown a moveable pliers member 12 with associated jaw member 13, which is formed at the outer end 12*a* of the pliers member 12. In the illustrated embodiment the two jaw members 11 and 13 are shown with concave, relatively slightly arched jaw surfaces 11*a* and 13*a*, but in practice the jaw surfaces can have arbitrarily other designs adapted according to the field of use of the pliers.

The pliers member 12 is provided with a shank portion (indicated by broken lines) 12*b* which is axially displaceably mounted in an associated guide on the shank portion or hand grip-forming portion 10*a* of the stationary pliers member 10.

The pliers member 10 extends laterally outwards from the portion 10*a* to form a bow-shaped head portion 10*b*, so that there is defined a longitudinal, relatively wide gap 14 between the pliers members 10 and 12 axially just behind the jaw members 11, 13. Outermost in the gap 14 there is formed on the bow-shaped head portion 10*b* of the pliers member 10 a first rack 15 and on the oppositely facing side of the outer end 12*a* of the pliers member 12 there is formed a second rack 16. Between the racks 15, 16 there is arranged a toothed wheel 17 which is disposed in permanent engagement with the racks 15, 16. The toothed wheel 17 is pivotably mounted via a pivot pin 18 at the outer end of a pair of mutually parallel actuating arms 19. The actuating arms 19 are pivotably mounted at the opposite end about a pivot pin 20 on an actuating handle 21. The second jaw member 13 projects with a portion 13*a* from the pliers member 12 laterally inwards into the gap 14, where the portion 13*a* forms a stop piece for the toothed wheel 17 in the fully opened, inactive position of the pliers. The toothed wheel 17 and actuating arms 19 thus form a first actuating means between the handle 21 and the movable pliers member 12 for moving the pliers member 12 relative to the stationary pliers member 10 in response to pivoting of the handle 21 in order to move the jaw members 11, 13 toward each other to close on an object 23 therebetween.

The actuating handle 21 is pivotably mounted, at a suitable distance from the pivot pin 20, that is to say at the outer end 21*a*, about a pivot pin 22 on the head portion 10*b* of the pliers member 10. The opposite portion 21*b* of the actuating handle 21 constitutes, together with the rear portion 10*a* of the pliers member 10, hand grip portions of the pliers, with which the clamping force of the pliers is manually exerted. By squeezing together the hand grip portions 10*a*, 21*b* the toothed wheel 17 is rolled along the rack 15 on the head portion 10*b* of the pliers member 10 and thereby advances the pliers member 12 from the position shown in FIG. 1 to that shown in FIG. 2, in which jaw members 11, 13 of the pliers form supporting abutments against an object 23 which is to be secured/clamped between the jaw members.

In the illustrated embodiment pivot pin 18 of the toothed wheel 17 is displaceably received in a respective slide groove 24 in the two mutually parallel actuating arms 19 (one on each side of the pliers member 10). Between the pivot pin 18 and the rear end of the slide groove 24 there is inserted a compression spring 25.

The spring 25 which is inserted in each actuating arm 19 shall have initially sufficient strength to guide the jaw members 11, 13 together—without itself being compressed—if the movable jaw member is not exposed to counter-pressure. Furthermore the spring 25 shall, with the least possible force, allow itself to be compressed to a length which corresponds to the distance between the greatest and the least movement of the jaw member in a particular movement zone for the pliers in the first phase of movement. There is therefore no thought that the spring shall contribute substantially with clamping force in the subsequent second phase of movement. The reason for this is that one wishes to exert a greatest possible part of the available clamping force against the actuating arms via the sliding pawl 26, provision being made for this to have a larger "force gearing".

About the pivot pin 20 there is pivotably mounted the one end 26*a* of a sliding pawl member 26, opposite end 26*b* of which is tapered in order to form a supporting abutment against the bottom of an appropriate locking groove 27 in a series of such locking grooves, which are arranged on the pliers member 12 just behind the rack 16. On an engagement between the sliding pawl member 26 and an appropriate locking groove 27 in the position illustrated in FIG. 3, that is to say at the end of the two-step movement, there can be exerted by an additional squeezing together of the hand grip portions 10*a*, 21*b* via the sliding pawl member 26 an extra clamping force between the jaw members after the springs 25 are compressed to the maximum.

In the illustrated embodiment, the sliding pawl 26 is shown arranged between the actuating handle 21 and the one actuating arm 19. The sliding pawl 26 is secured in a set angular position relative to the actuating handle by means of a double-acting spring 26*f*.

Figure 2:
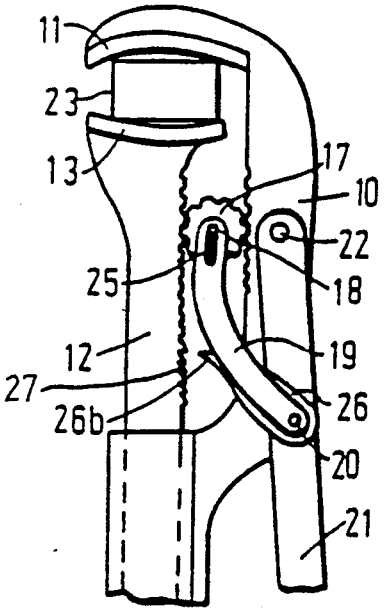
FIG. 2 shows in a side view a part of the pliers according to FIG. 1 after a first step of a two-step movement is conducted.

In the embodiment illustrated in FIGS. 1–3 there is employed a slide groove 24 for pivot pin 18 of the toothed wheel 17 and associated compression spring 25 in connection with the slide groove 24 in the actuating arms 19. Alternatively the arms can be designed in the form of a double-acting telescopic arm, one end of which is provided with a fork portion which carries pivot pin 18 of the toothed wheel 17 stationarily mounted in the fork portion and the opposite end of which is rotatably mounted about a pin equivalent to the pivot pin 20 on the handle 21.

By means of the toothed wheel 17 and the racks 15, 16 there is achieved, with a small pivotal arc for the handle 21, a relatively large axial movement of the pliers member 12 relative to the pliers member 10. Alternatively the toothed wheel and the racks can be omitted, there being effected then only half as large an axial movement of the pliers member 12 relative to the pliers member 10, by fastening the fork portion of the telescopic arm rotatably mounted directly on the pliers member 12.

Alternatively instead of arms there can be employed a joint arm mechanism, which provides correspondingly strong movement of the second pliers member relative to the actuating handle. More specifically, instead of fastening the arms 19 or the telescopic arm rotatably mounted directly on a stationarily arranged pin 20 on the handle 21, the pin 20 can be allowed to travel in a longitudinal groove in the handle 21 and the pin 20 can be allowed to form a pivot pin between the arms or telescopic arm and an additional support arm, which are rotatably mounted on the pliers member 12. In such a case, the support arm can form an angle up to, but not greater than, 90°, with the handle 21 in the fully opened position of the pliers and with a gradually declining angle between these little by little as the handle 21 is squeezed against the pliers member 12, there being formed between the arms (the arms 19 or the telescopic arm and the support arm) an acute angle in the starting position and an obtuse angle in the clamp engagement position.

Referring to FIG. 3*a* wherein like reference characters indicate like parts as above, the first actuating means for the pliers device may include a joint arm mechanism consisting of a first joint arm 50, one end of which is linked to the movable pliers member 12 and the other end of which is linked to actuating handle 21. In addition, the joint arm mechanism has a second joint arm 51, one end of which is linked to the stationary pliers member 10 and the other end of which is linked to the handle 21. As illustrated, the two joint arms 50, 51 are mutually linked to each other, preferably at a common, acute or obtuse angle, via a pivot pin 54 which is laterally displaceable in an axially extending guide groove 55 in the actuating handle 21.

Instead of the illustrated pawl member with associated pawl teeth on the pliers member 12 there can be employed a friction-promoting promoting or lock-forming clamping means in connection with the handle 21, together with an equivalent friction-promoting or lock-forming engagement surface on the pliers member 12.

In each case one can ensure that the pawl member or a similar friction-promoting or lock-forming clamping means can be readily brought, during the first phase of the clamping movement of the pliers against an abutment surface on the pliers member 12 equivalently toothed or friction-promoting or lock-forming in another way, but as a consequence of the relatively large axial movement of the pliers member 12 there can be ensured an introductory sliding movement of the pawl member or similar clamping means along (past) the abutment surface without an effective locking action. Immediately the axial movement of the pliers member 12 is stopped (by closing jaw members of the pliers about the object which is to be clamped), one can however by further pivoting the actuating handle, during compression of the spring 25 or an equivalent spring in the telescopic arm exert a clamping force of great strength directly between the jaws of the pliers by means of the clamping force which is exerted between the handle 21 and the pliers member 12 via the pawl member 26.

In FIG. 4 and 5 there is illustrated a solution where there can be employed an "over dead center" pivotable locking member 30 with associated locking mechanism 31 in connection with the adjustment of the locking member 30 about the dead center. The locking member 30 is pivotably mounted in a manner corresponding to the pawl member in FIG. 1–3 about a pin 20 on the handle 21. The pin 20 is fastened to the locking member 30 and is moveably arranged in an oval rotary groove 32 on the handle 21. The locking member 30 with associated pin 20 are adapted to be displaceable a limited length from the upper position shown in FIG. 4 in the groove 32 to a lower position (not shown further) in the groove 32, against the force from a compression spring 33. In this connection, the locking member 30 is provided below with a nose portion 30*a* which forms a supporting abutment against a stop 34 which is fixed to the upper end of the compression spring 33. Instead of a single pawl tooth, the locking member 30 is provided above with a tooth segment 30*b* with a series of pawl teeth 35 arranged along a surface which is arched or curved in another manner. In FIG. 4 the locking member 30 is shown in an introductory engagement position with supporting abutment between the pawl teeth 35 and the teeth 36 on a rack 37 which is fastened to the pliers member 12.

In FIG. 4, the pawl teeth 35 of the locking member 30 are initially clamped against the teeth 36 of the rack 37 on the pliers member 12 by exerting a manual clamping force between the member 12 and the handle 21. Upon applying additional clamping force between the member 12 and the handle 21, the pawl teeth 35 of the locking member 30 are forced to roll against the teeth 36 of the rack in the pliers member 12 against the counter force provided by the spring 31 via the stop 34. This means that the locking member 30 is being forced to pivot in a clockwise direction, as viewed, towards the position illustrated in FIG. 5, that is, moved over a dead center. At the same time, the pin 20 is moved for the top of the groove 32 towards the bottom of the groove 32. Once the locking member 30 has passed a dead center position, the compressed spring 33 forces the pin 20 from the bottom of the groove 32 towards the top of the groove simultaneously as the locking member 30 continues to pivot in a clockwise direction into the position illustrated in FIG. 5. During this time, the blade spring 38 is moved from the position shown in FIG. 4 to the position shown in FIG. 5.

During the time that the locking member 30 is pivoted clockwise via the pin 20, the pliers member 12 is moved upwardly, as viewed.

Referring to FIG. 5 in order to release the pliers device, the blade spring 38 is pivoted in a clockwise direction, as viewed, so as to move the locking member 30 in a counter-clockwise direction towards the position shown in FIG. 4. This pivoting is again carried out against the counter force exerted by the spring 33 and is provided by simultaneously moving the pin 20 from the top to the bottom of the groove 32 and back again to the top position in the groove 32. Thus, the locking member 30 will be positioned in the starting position illustrated in FIG. 4 by sole actuation of the blade spring 38. This means that the member 12 and the handle 21 are released for unrestricted pivotal as well as axial movements.

On actuation of a blade spring 38, which is fastened to the handle 21 at 38*a*, with a releasing force which is indicated by the arrow 39, one can readily readjust the locking means from the locking engagement position in FIG. 5 to the introductory engagement position which is shown in FIG. 4. Thereafter by pivoting the handle 21 from the position in FIG. 4 away from the pliers member 12, the handle 21 is swung back in an unhindered manner to the outwardly swung starting position, corresponding to fully opened pliers.

In FIG. 6 there is shown an alternative construction, where the handle 21 is connected to the pliers member 12 via a flexible band 40 (or if desired flexible cord). One end 40*a* of the band 40 forms a support against a bottom portion 12*c* in the pliers member 12 internally in the pliers member 10 via an intermediate compression spring 41. The opposite end 40*b* of the band 40 is secured directly to the lower, inwardly facing portion of the handle 21. In the opening 42 between lower ends of the handle 21 and the pliers member 10, there is inserted a compression spring 43 which surrounds the band 40 and which seeks to press the handle 21 in the direction away from the pliers member 10.

In the illustrated embodiment the handle 21 is made with a U-shaped cross-sectional profile, with the opening of the U shape facing towards the pliers member 10. At the upper end of the handle 21 there are formed two opposite ears 21*a* which are arranged one on each side of head portion 10*b* of the pliers member 10. The pawl member 26 is adapted to be received pivotably mounted on the pin 20 between two opposite legs of the U shape. There is shown a spring 26*a* which ensures the pawl member 26 is in place in the illustrated position, but which permits a certain pivoting of the pawl member against the force of the spring 26*a*. In the illustrated embodiment, the pliers member 10 is shown in the form of a cast main component with an associated cover 10*d* which is fastened with screws 10*e*. Internally in a hollow space which is defined by the main component and the cover 10*d* there are defined guides for the pliers membere 12, the spring 41 and the band 40.

By pivoting together the handle 21 and the pliers member 10, against the force of the spring 43 and against the force of the spring 41, the band 40 is pushed via the spring 41 against the pliers member 12 and there is ensured thereby that the pliers member 12 clamps via the jaw member 13 the object 23 into place between the jaw members 11 and 13. After this first phase of the clamping together is effected and one grips the handle 21 additionally against the pliers member 10, the springs 41 and 43 are further compressed, at the same time as an increased elastic force is exerted against the object 23 via the jaw member 11 and 13, until pawl tooth of the pawl member 26 engage with associated teeth on the rack of the pliers member 12 and the force can be directly transferred from the handle via the pawl member 26 to the pliers member 12, whereby the clamping force can be regulated with great intensity (and minimal mutual movement between the jaw members).

I claim:

1. A pliers device comprising a first pliers member having a first jaw member;

a second pliers member movably mounted in said first pliers member and having a second jaw member opposite said first jaw members;

an actuating handle pivotally mounted on said first pliers member;

a first actuating means between said handle and said second pliers member for moving said second pliers member relative to said first pliers member in response to pivoting of said handle to move said jaw members toward each other to close on an object therebetween; and a second actuating means between said handle and said second pliers member for moving said second pliers member relative to said first pliers member in response to pivoting of said handle to move said jaw members toward each other to exert a clamping force on an object therebetween.

2. A pliers device as set forth in claim 1 wherein each pliers member has a toothed rack facing the other pliers member and said first actuating means includes a toothed wheel disposed between said racks of said first and second pliers members and at least one actuating arm rotatably mounting said wheel thereon, said arm being pivotally mounted on said handle for moving said wheel along said racks in response to pivoting of said handle.

3. A pliers device as set forth in claim 2 wherein said first actuating means includes a first joint arm pivotally connected to said second pliers member, a second joint arm pivotally connected to said first pliers member and a pivot pin pivotally connecting said joint arms to each other and being slidably mounted on said handle.

4. A pliers device as set forth in claim 1 wherein said second pliers member has a row of grooves facing said first pliers member and said second actuating means including a pawl member pivotally mounted on said handle for engaging in said row of grooves and a spring biasing said pawl member into a set angular position relative to said handle.

5. A pliers device as set forth in claim 1 wherein said second pliers member has a row of grooves facing said first pliers member and said second actuating means includes a locking member pivotally mounted in said handle and having a tooth segment at one end for engaging with said row of grooves and a nose portion at an opposite end and a compression spring engaging said nose portion to maintain said locking member in locking engagement with said second pliers member in an over dead center position of said locking member.

6. A pliers device as et forth in claim 1 wherein said first actuating means includes a flexible band secured at one end to said handle and having an opposite end slidably disposed within said first pliers member.

7. A pliers device as set forth in claim 6 which further comprises a compression spring surrounding said band and disposed between said first pliers member and said handle.

* * * * *